United States Patent [19]

Wriedt

[11] Patent Number: 4,489,865

[45] Date of Patent: Dec. 25, 1984

[54] HOLDING MEANS APPARATUS

[76] Inventor: William A. Wriedt, 2133 Barberry La., Green Bay, Wis. 54304

[21] Appl. No.: 561,948

[22] Filed: Dec. 15, 1983

[51] Int. Cl.[3] ..... D05B 87/00

[52] U.S. Cl. ..... 223/99; 223/106

[58] Field of Search ..... 223/99, 106, 120, 108, 223/109 R; 38/102.2

[56] References Cited

U.S. PATENT DOCUMENTS

| | | | |
|---|---|---|---|
| 1,016,463 | 2/1912 | Wilkins | 38/102.2 |
| 2,412,505 | 12/1946 | Gorka et al. | 223/99 |
| 2,419,495 | 4/1947 | Lehmann | 223/99 |
| 2,777,623 | 1/1957 | Balzer | 223/99 |
| 3,906,648 | 8/1975 | Bard | 38/102.2 |
| 3,955,722 | 5/1976 | Bard | 223/106 |
| 4,029,241 | 6/1977 | Krake | 223/106 |
| 4,351,458 | 8/1982 | Wolfe | 223/106 |

*Primary Examiner*—Louis K. Rimrodt
*Assistant Examiner*—J. L. Kravitz
*Attorney, Agent, or Firm*—Russell L. Johnson

[57] ABSTRACT

The device of this invention performs the functions of one hand in performing a variety of the tasks ordinarily requiring two hands while doing needle craft, yarn work and the like. The invention may serve those having the use of both hands but is specifically developed to meet the needs of those who have the use of only one hand. The device is characterized by a stand having a base and an upright standard and a horizontal arm joined to the top of the standard by means of a free pin hinge. In the mid region of the standard is positioned a rotatable tray having upward angled pegs around its perimeter for holding yarns, strands, spools and the like and the tray has in its top surface shallow troughs for holding small implements, needles, hooks and the like. The top surface of the horizontal arm has a spring loaded clamp near its free end and an upward directed binding post near the clamp and a plate having a multiplicity of various sized holes passing through the plate and the arm below the plate. The clamp, post and holed plate serve to enable a person to tie a knot and draw it tight while using only one hand. A turret having several sizes of needle threaders is rotatably mounted to the underside of the arm. Pin cushions are secured to the arm and standard.

4 Claims, 5 Drawing Figures

HOLDING MEANS APPARATUS

BACKGROUND OF THE INVENTION

People who lose the use of a hand often are denied the pleasures and therapeutic benefits of participating in needlecrafts and the like because their physical limitations do not permit them to perform tasks which are done easily by those having two hands. Threading needles, tying knots, maintaining separation of yarns and the like are some of the acts that people with the use of only one hand can only do with great difficulty if they can do them at all.

DISCUSSION OF THE PRIOR ART

The prior art devices fall into two broad categories: The first is the group of devices which hold and/or position the work piece. U.S. Pat. Nos. 3,906,648 and 1,016,463 are representative of this group. The second is the group of devices which hold and maintain the order and availability of the materials and tools used by the needlecrafter. U.S. Pat. Nos. 4,351,458 and 4,029,241 are representative of this group. U.S. Pat. No. 3,955,722 teaches an apparatus that combines these two functions. The applicant is unaware of any prior art devices which teach the performance of or would serve the functions of a second hand.

OBJECTS

It is therefore an object of this invention to provide a device which serves the functions of one of the two hands of a needlecrafter.

It is further an object of this invention to provide the above device with an arrangement of the mechanisms to perform the tasks required for needlework and crafting and the like, such that they are positioned to facilitate the sequential steps of many of the common tasks performed in needlecrafting and the like.

It is further an object of this invention to secure the above referred to mechanisms to the device so that the holding function normally performed with one hand is performed by the mechanism and/or the positioning function normally performed by one hand is performed by the mechanisms.

It is further an object of this invention to construct and arrange the components and elements of the above described device so that only one hand is required to transport position and use the device of this invention.

Other objects will become apparent from the following specifications, drawings and from the appended claims.

BRIEF DESCRIPTION OF THE INVENTION

The invention in its simplest form is characterized by having a base from which a standard projects upward and a horizontal arm removably joined to the top of the standard by a free pin hinge and a materials and instruments tray is rotatably mounted in the mid region of the standard and the tray has shallow depressions formed in its top surface and which serves to hold needles, hooks, pins and the like and the outside perimeter of the tray has pins projecting upwardly therefrom and the pins are capable of holding yarns, strings, spools and the like. The horizontal arm has a binding post projecting upward near its free end and close to the binding post on the top surface of the arm is a plate having a multiplicity of holes of different diameters passing through the plate and through the arm. Adjacent to the plate is a spring loaded clamp which is configured so that the clamp may be opened with one finger or the thumb of one hand, remains latched open until it is freed by the action of one finger or a thumb. Underneath the arm and adjacent to the clamp is rotatably mounted a turret carrying a multiplicity of needle threaders. Pin cushions are secured to the standard and the arm at convenient locations. A pivoting bail type carrying handle is mounted to the top of the standard.

DETAILED DESCRIPTION OF THE DRAWINGS

Figure 1:
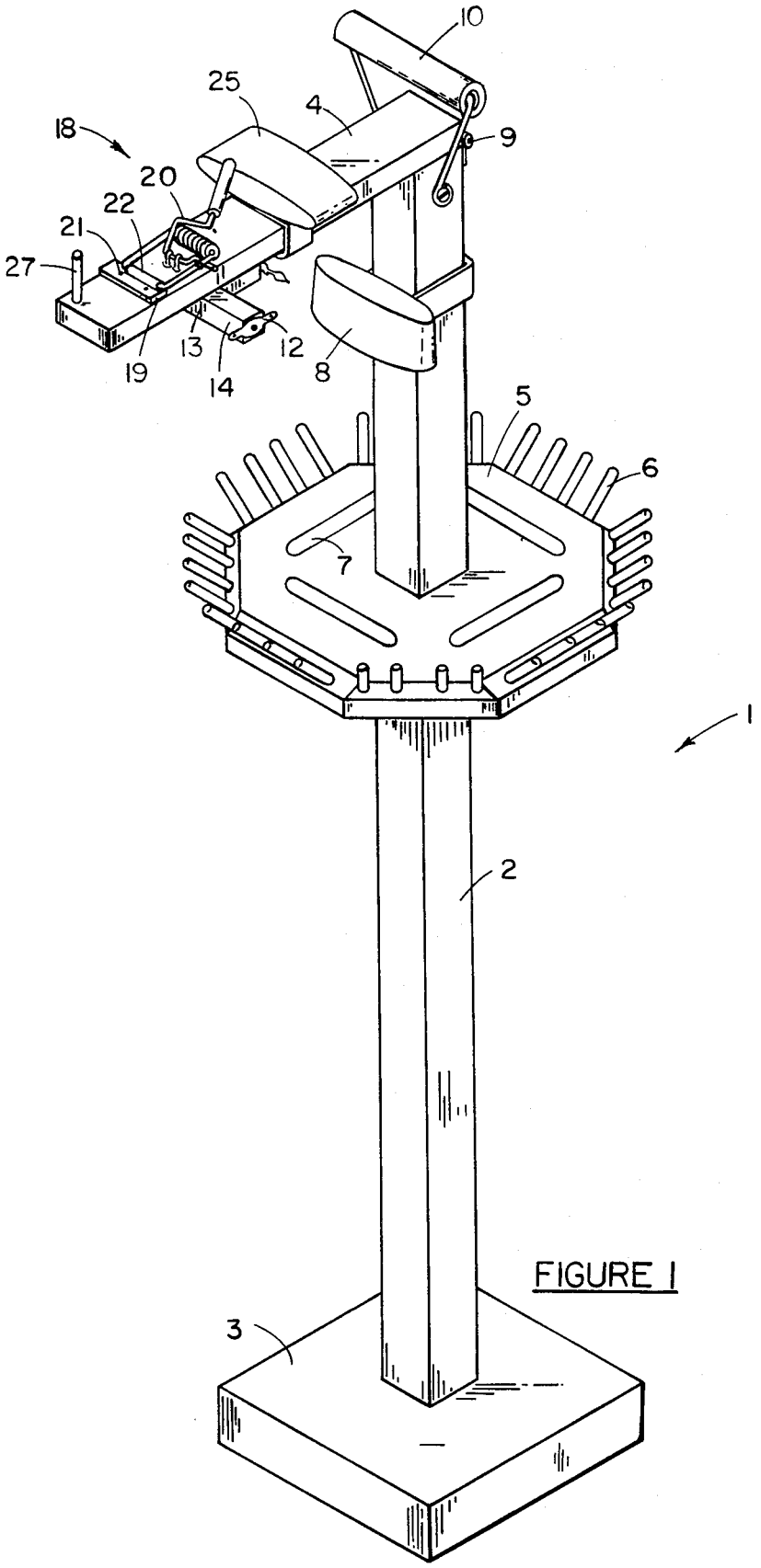
FIG. 1 is a pictorial view of the device of this invention.

In the figures like numbers refer to like objects.

The device 1 of this invention may be regarded as an extra hand which serves the functions of positioning, holding and the like when threading a needle and tying a knot during the performance of needlecraft. The positional relationships of, as well as the functions performed by the elements of the device are important to the successful device for threading needles and tying knots with one hand.

Referring now to FIGS. 1 through 5.

The device of this invention has an upright standard 2 supported at the bottom by base 3 and having hingeably attached to the top of standard 2 horizontal arm 4. Standard 2 has rotatable turntable 5 mounted to the midspan of standard 2. Turntable 5 has upward angled pegs 6 distributed around its perimeter and shallow grooves 7 are formed in the top surface of turntable 5. Standard mounted pincushion 8 is secured to standard 2 at a location near hinge 9.

Hinge 9 serves to enable the one handed needlecrafter to swing arm 4 into position for threading needles and tying knots in threads, yarns and the like and then to move arm 4 out of the way when not in use.

Bail type carrying handle 10 is secured near the top end of standard 2 and is positioned so that the balance of device 1 permits the employment of handle 10 to transport device 1 without the need for a second hand to guide or balance device 1.

For those of us with the full use of two hands it is difficult to give the proper weight to the seemingly trivial functions performed by one hand in assisting the other hand to perform simple tasks. These functions are usually that of holding and positioning.

Arm 4 has mounted thereon a number of devices which are designed to perform the holding and positioning functions ordinarily performed by one hand during the threading of a needle and the tying of a knot in the threaded strand. Device 1 is configured and the elements of device 1 are positioned so that the functions performed and the ends achieved may be accomplished by the use of these elements and the manipulations of one hand.

The elements and their interactive functions and operation will be described in conjunction with a typical sequence of operations performed by a person using the right hand. It should be understood that device 1 is equally well configured to be employed using only the left hand.

Needle 11 is removed from groove 7 of turntable 5 and placed on needle threader 12 which is secured to rotatable turret 13. Turret 13 may have a number of threader mounts 14 to carry different sizes of needle threaders. Turret 13 may be rotated about pin 15 and locked in place by a wing nut (not shown-positioned under turret 13). By rotating turret 13 to the desired position it can serve a right or left handed user as needed.

Figure 3:
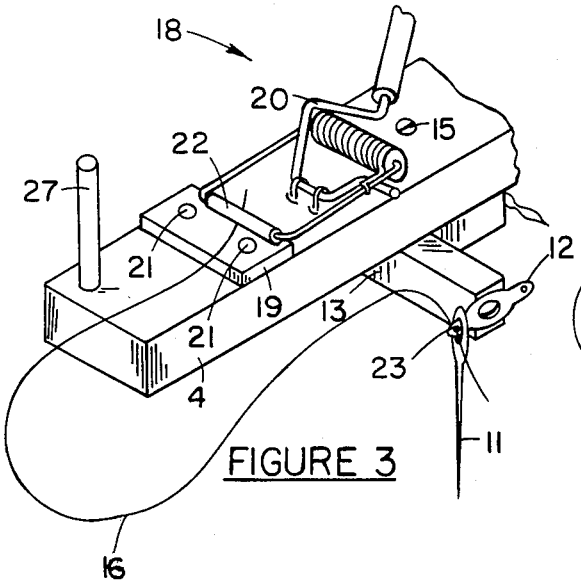
FIG. 3 is a partial pictorial view of the device of FIG. 1 showing the relationship between the needle threading means and the knot tying mechanisms.
Figure 2:
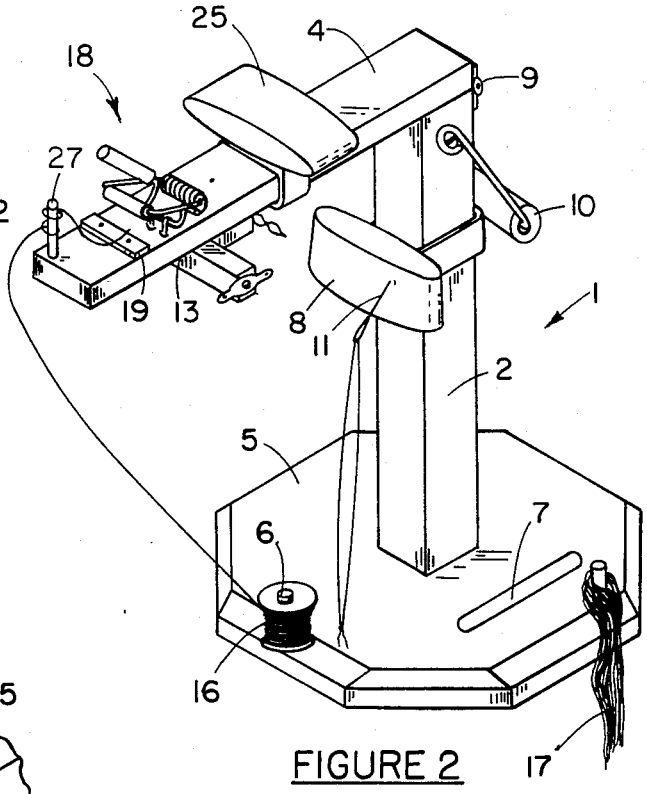
FIG. 2 is a partial pictorial view of the configuration of the device of FIG. 1 preparatory to its employment to thread a needle and tie a knot showing the relationship between the strand holding tray and the knot tying mechanism.

A strand to be threaded on needle 11 is then selected from one of the angled pegs 6 of turntable 5. For illustration purposes thread 16 has been selected but the device of the invention will serve equally for other strands such as yarns 17. Clamp 18 which is manipulatable with one hand while holding a strand in position on plate 19 is latched in the open position as illustrated in FIG. 2 by the camming action of lever 20. Thread 16 is wrapped around looping post 27 so as to hold the position of thread 16 while the free end of thread 16 is placed on plate 19 near one of the clinching holes 21 and bail 22 of clamp 18 is lowered to hold the end of thread 16 between bail 22 and plate 19 as illustrated in FIG. 3. Thread 16 may then be unlooped from looping post 27 and thread 16 cut to the desired length.

The free end of thread 16 is then passed through threader hole 23 of needle threader 12. Needle 11 may now be removed from threader 12 and the free end of thread 16 drawn through eye 24 of needle 11. If needed, arm pincushion 25 may be employed to hold needle 11 while the positioning of the thread in the needle is adjusted.

Figure 4:
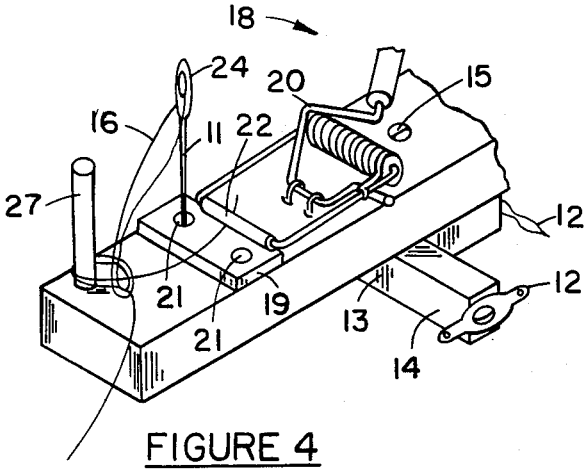
FIG. 4 is a partial pictorial view of the device of FIG. 1 showing the manner of operation of the knot tying employing binding post, clamp and a knot tightening plate.
Figure 5:
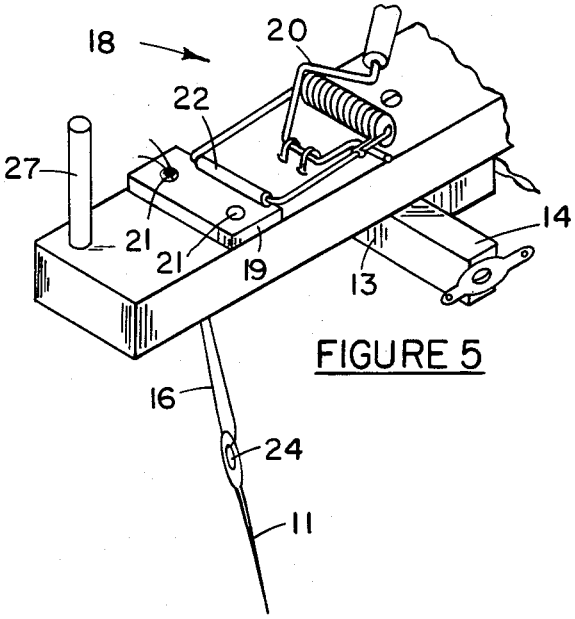
FIG. 5 is a partial pictorial view of the device of FIG. 1 illustrating the knot tightening function at the end of the threading and knotting sequence.

Needle 11 is next employed to pass thread 16 around looping post 27 and over the portion of thread 16 held in clamp 18 and then to pass under that portion of thread 16 forming a loop as illustrated in FIG. 4. Needle 11 is then passed through clinching hole 21 in plate 19. Clinching hole 21 passes through plate 19 and arm 4. Thread 16 is then unlooped from looping post 27 and thread 16 is drawn downward through clinching hole 21 until the overhand knot formed in thread 16 by the above described steps is drawn taut. Further tension on thread 16 will draw the clinched knot through hole 21 and draw the held end of thread 16 in from under clamp 18.

The threaded and knotted needle may then be placed in standard pincushion 8 while additional needles and threads are prepared or for storage until needed.

The one handed operation of device 1 of this invention has been disclosed and described so as to enable one skilled in the art to make and use the invention without undue experimentation. The best mode of making and using the invention is disclosed. The range of utility of the invention for preparing needlecraft materials by a person using only the right or only the left hand has been disclosed.

It should be understood however, that the scope of the invention should not be limited to that specified and disclosed herein but should be limited only by the scope of the appended claims and all equivalents thereto which would become readily apparent to one skilled in the art.

I claim:

1. A device for the one handed threading of the eye of a needle and the knotting of the strand threaded through the eye of the needle and comprising;

(1) a holding and positioning structure having a base, a verticle standard projecting upward from the base and having a top end and a horizontal arm having one end joined to the top end of the standard at a right angle and the other end of the arm as a free end, (2) a turntable rotatably mounted to the standard in the midspan of the standard between the base and the top end of the standard and the turntable has upward angled pegs around the perimeter of the turntable and the turntable has an upper flat surface in which shallow elongate grooves are formed for holding needles, small implements and the like, (3) a mousetrap like spring loaded clamp secured to a top surface of the horizontal arm a short distance inward from the free end of the arm, (4) a looping post projecting upward from the top surface of the arm and located near the free end of arm, (5) a cinching plate secured to the top surface of the arm at a location between the looping post and the clamp and the cinching plate has at least one hole passing through the plate and continuing on through the horizontal arm, (6) a needle threader turret rotatably secured to an underside of the horizontal arm at a location inward from the free end of the arm and the needle threader turret has secured thereto at least one needle threader which is positionable so as to be readily employable by person having the use of only one hand, and (7) the positional relationship between the turntable, the looping post, the clamp, the needle threader, and the cinching plate are such as to provide close and direct access for the carrying of a thread, a needle and the like from one to the other for the purpose of threading the needle, knotting the strand threaded in the needle and cinching the knot thus formed by a person using only one hand.

2. The device of claim 1 wherein the clamp is provided with a cam like lever and the lever serves to open a bail type spring loaded clamp and to hold the clamp in the open position until the opening action of the lever is reversed to close the bail type clamp.

3. The device of claim 1 wherein the needle threader turret is provided with a multiplicity of needle threaders of different sizes and the turret employs a threaded wing nut to lock the turret in the position desired by the user.

4. The device of claim 1 wherein the horizontal arm is joined to the upright standard by means of a hinge and the end of the upright standard is provided with a bail type carrying handle.

* * * * *